US009052151B1

(12) United States Patent
Tseng

(10) Patent No.: US 9,052,151 B1
(45) Date of Patent: Jun. 9, 2015

(54) PAINTBALL GUN BARREL STRUCTURE

(71) Applicant: Shun Hui Precise Hardware Co., Tainan (TW)

(72) Inventor: Yao-Chieh Tseng, Tainan (TW)

(73) Assignee: Shun Hui Precise Hardware Co., Ltd., Tainan (TW)

( * ) Notice: Subject to any disclaimer, the term of this patent is extended or adjusted under 35 U.S.C. 154(b) by 0 days.

(21) Appl. No.: 14/203,616

(22) Filed: Mar. 11, 2014

(30) Foreign Application Priority Data

Jan. 21, 2014 (TW) ..... 103102099 A

(51) Int. Cl.
*F41B 11/80* (2013.01)
*F41A 21/00* (2006.01)

(52) U.S. Cl.
CPC ..... *F41A 21/00* (2013.01); *F41B 11/80* (2013.01)

(58) Field of Classification Search
USPC ..... 124/56, 58–61, 81; 42/90, 1.06, 78; 89/14.4; 181/223
See application file for complete search history.

(56) References Cited

U.S. PATENT DOCUMENTS 2,214,297 A * 9/1940 Ferry ..... 124/3
5,228,427 A * 7/1993 Gardner, Jr. ..... 124/71
6,440,013 B1 * 8/2002 Brown ..... 473/422
6,467,473 B1 * 10/2002 Kostiopoulos ..... 124/51.1
7,156,084 B1 * 1/2007 Landis ..... 124/50
7,603,998 B2 * 10/2009 Finstad ..... 124/81
8,141,493 B1 * 3/2012 Kuchman ..... 102/439
2002/0020401 A1 * 2/2002 Grichen ..... 124/71
2002/0020402 A1 * 2/2002 Kotsiopoulos ..... 124/76
2003/0168052 A1 * 9/2003 Masse ..... 124/73
2004/0065310 A1 * 4/2004 Masse ..... 124/75
2007/0017498 A1 * 1/2007 Finstad ..... 124/84
2007/0157915 A1 * 7/2007 Benetti et al. ..... 124/71
2009/0241931 A1 * 10/2009 Masse ..... 124/76
2010/0154766 A1 * 6/2010 Skilling ..... 124/71
2012/0152145 A1 * 6/2012 Kuchman ..... 102/439
2013/0213377 A1 * 8/2013 Kenworthy ..... 124/62
2014/0007857 A1 * 1/2014 Schlosser ..... 124/81

* cited by examiner

*Primary Examiner* — Michael David

(74) *Attorney, Agent, or Firm* — Alan D. Kamrath; Kamrath IP Lawfirm, P.A.

(57) ABSTRACT

A paintball gun barrel structure, mainly for the proper adjustment of the inner diameter of the barrel of the paintball gun for firing paint balls according to the size of the paint balls when paint balls are loaded into the barrel, to keep proper point contact with the surfaces of the paint balls, and to prevent excess interference between the interior of the barrel and the paint balls, and to thusly enhance the stability of the ballistics of the interior of the barrel so that paint balls may be fired with high accuracy when being fired towards the barrel under the control of an operation unit.

6 Claims, 8 Drawing Sheets

PAINTBALL GUN BARREL STRUCTURE

BACKGROUND OF THE INVENTION

1. Technical Field

The disclosure relates to a paintball gun barrel structure, mainly for the proper adjustment of the inner diameter of the barrel of the paintball gun for firing paint balls according to the size of the paint balls when paint balls are loaded into the barrel, to keep proper point contact with the surfaces of the paint balls, and to prevent excess interference between the interior of the barrel and the paint balls, and to thusly enhance the stability of the ballistics of the interior of the barrel so that paint balls may be fired with high accuracy when being fired towards the barrel under the control of an operation unit.

2. Description of Related Art

In view of the domestic development of the outdoor activity of paintball sports, relating manufacturers have been designing the components of the paintball gun structure to further achieve firing accuracy for the past 20 years, and to facilitate light handling and precise aiming usage during user operation at the same time. Among these, the barrel assembly of the paintball gun structure usually comprises an engaging barrel section screwed on one end of a barrel and a firing barrel section screwed on the other end of the barrel to construct a barrel assembly, and the engaging barrel section of the barrel is directionally assembled with an operation unit for controlling the firing of paint balls and allowing the loading of paint balls to construct a complete paintball gun.

The inventor hereby improves the barrel allowing paint balls to reside within when waiting to be fired; although the barrel in above accomplishes the application of firing paint balls in usage due to smooth walls inside the barrel, yet since the present paint balls remains to be in the situation of unable to achieve perfect spheres or unable to completely achieve shapes of standard specification sizes (i.e., part of the paint balls are in standard sizes and part of them are in smaller non-spherical shapes), when the paint balls are loaded into the barrel and waiting to be fired, they are easily pushed and squeezed and as a result, the surfaces of part of the paint balls do not contact with the wall inside the barrel and causes the reduction of the firing accuracy.

The inventor presents an advanced design for the barrel waiting to fire paint balls for the above paintball gun to allow the proper adjustment of the inner diameter of the barrel according to the size of the paint balls when paint balls are loaded into the barrel, to keep proper point contact with the surfaces of the paint balls, and to prevent excess interference between the interior of the barrel and the paint balls, and to thusly enhance the stability of the ballistics of the interior of the barrel so that paint balls may be fired with high accuracy when being fired towards the barrel under the control of the operation unit.

BRIEF SUMMARY OF THE INVENTION

The present invention improves accordingly the deficiency of the instability of the ballistics of the interior of the barrel caused by the excess interference or by the part of the paintballs not contacted with when the barrel of conventional paintball guns contact with paintballs, and solves by the proper adjustment of the inner diameter of the barrel according to the size of the paint balls when paint balls are loaded into the barrel, to keep proper point contact with the surfaces of the paint balls, and to prevent configuring excess interference with the surfaces of the paint balls so that paint balls may be fired with high accuracy when being fired towards the barrel under the control of the operation unit.

In the main purpose of the present invention, a barrel assembly of a paintball gun comprises a plurality of grooves symmetrically distributed along a wall of a default section of the barrel equidistantly, wherein each groove is wide on the outside and narrow on the inside and is connected to an interior of the barrel to individually contain a suppressor and to let an inside portion of the suppressor to slightly protrude into the interior of the barrel, and wherein a concave section inside one end of a casing tube is directionally engaged with a slightly smaller receiving section of a corresponding end of another casing tube on an exterior of the barrel containing the suppressors to directionally restrain a plurality of suppressors placed on the exterior of the barrel; an adjustment tube with a proper slit on one side directionally covering along another section of the barrel, wherein at least two rings are configured on an exterior of the adjustment tube to properly tighten or loosen the diameter of the adjustment tube and to timely control the plurality of suppressors contained in the barrel to contract towards the interior of the barrel or remain horizontal normally, and wherein a restraining tube is configured at an outlet end of the barrel to directionally restrain the adjustment tube, and an engaging barrel section is connected at an inlet end of a barrel and a firing barrel section is connected at the outlet end of the barrel; and the barrel assembly properly controls the tightness of the adjustment tube by the displacement of the at least two rings configured on the exterior of the adjustment tube according to the size of a paint ball when the paint ball is loaded into the barrel, to keep proper point contact of the plurality of suppressors contained in the barrel wall with the surfaces of the paint balls, and to prevent configuring excess interference with the surfaces of the paint balls so that the paint balls are fired with high accuracy when being fired towards the barrel under the control of an operation unit.

In the second purpose of the present invention, each of the plurality of grooves distributed along the default section of the wall of the barrel equidistantly is in the interval form of being deeper on the upper side and shallower on the lower side.

In the third purpose of the present invention, each of the plurality of grooves distributed along the default section of the wall of the barrel equidistantly extends in parallel.

In the fourth purpose of the present invention, each of the plurality of grooves distributed along the default section of the wall of the barrel equidistantly extends in helical.

In the fifth purpose of the present invention, the surfaces of the rings configured on the exterior of the adjustment tube with the proper slit on one side covering along another section of the barrel are embossed to facilitate force application when gripping and twisting by hands.

DETAILED DESCRIPTION OF THE INVENTION

Figure 1:
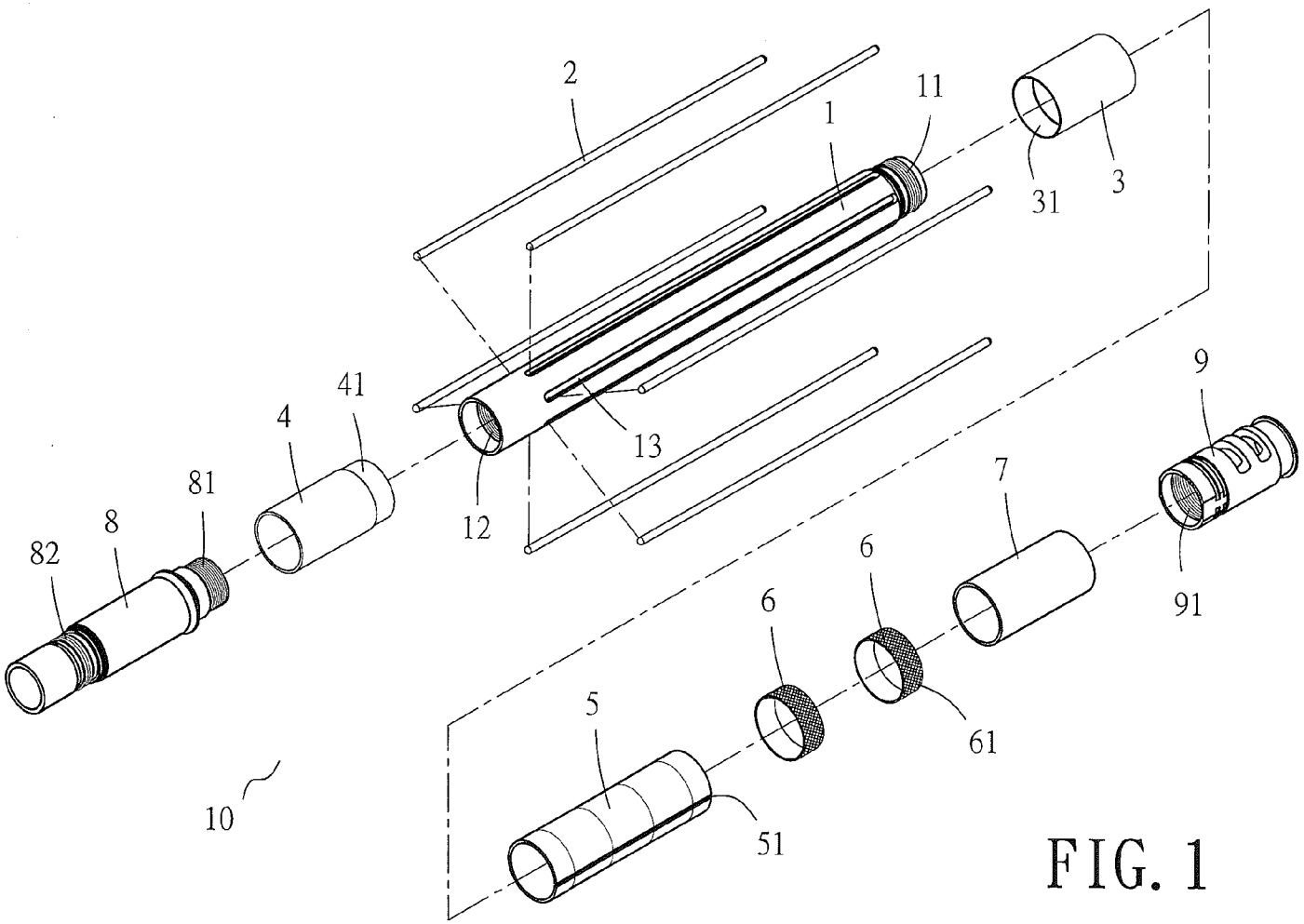
FIG. 1 is a breakdown drawing of the barrel components of a paintball gun according to an embodiment of the invention.

The paintball gun barrel structure (as shown in FIG. 1) for a barrel assembly 10 of a paintball gun comprises: a barrel 1, a plurality of suppressors 2, two casing tubes 3 and 4, an adjustment tube 5, at least two rings 6, a restraining tube 7, an engaging barrel section 8, and a firing barrel section 9.

Figure 4A:
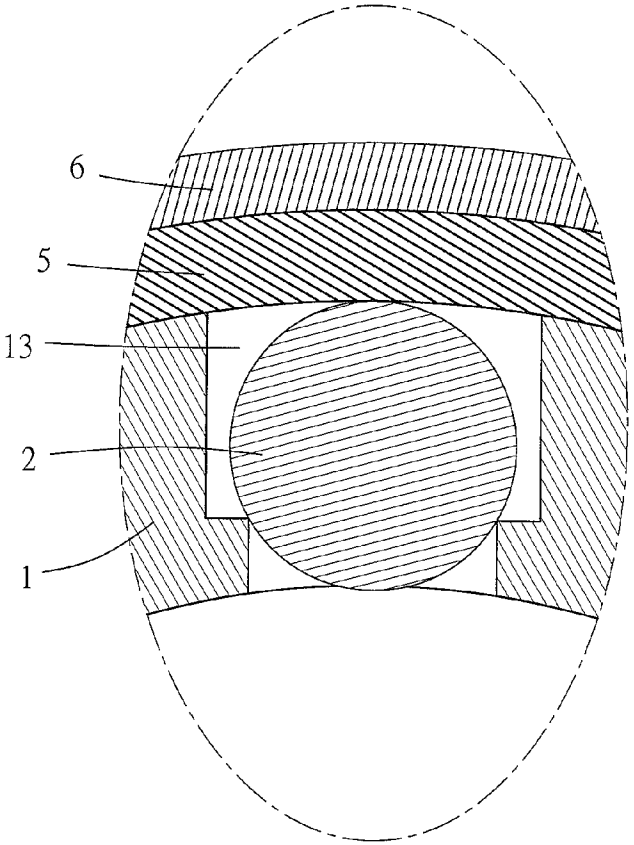
FIG. 4A is an enlarged diagram for details of part A of FIG. 4.
Figure 8:
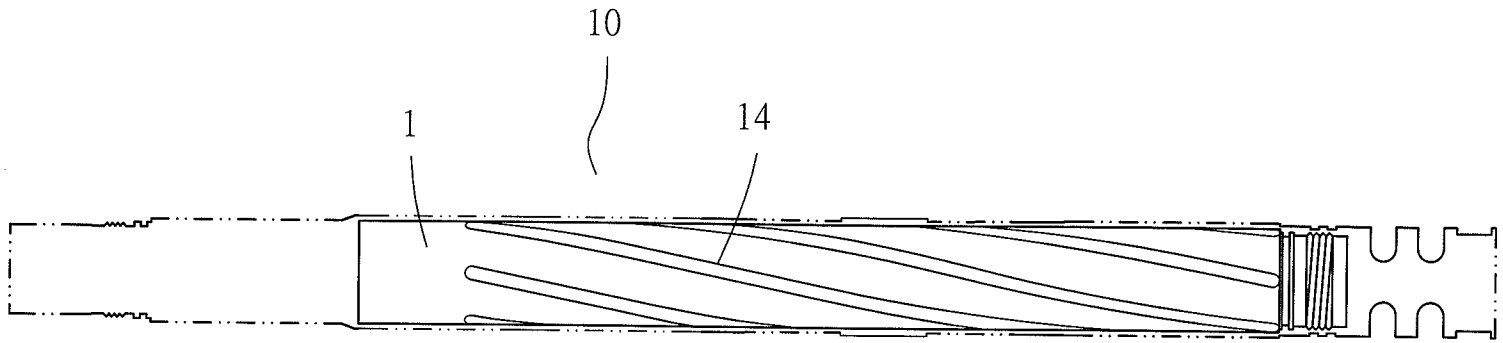
FIG. 8 is a schematic diagram for the barrel according to another embodiment of the invention.

The barrel 1 has on one end an external thread barrel section 11 and on the other end an internal thread barrel section 12, wherein a plurality of grooves 13 are symmetrically distributed along a wall of a default section of the barrel 1 equidistantly, wherein each groove 13 is wide on the outside and narrow on the inside and is connected to an interior of the barrel 1, wherein each of the plurality of grooves 13 is in the interval form of being deeper on the upper side and shallower on the lower side (as shown in FIG. 4A), and wherein each of the plurality of grooves 13 distributed along the default section of the wall of the barrel 1 equidistantly are implemented as extending in parallel (each of the plurality of grooves 14 distributed along the default section of the wall of the barrel 1 equidistantly may also be extending in helical in another embodiment (i.e., rifling), as shown in FIG. 8).

The plurality of suppressors 2 are bars with corresponding lengths determined according to the form of the grooves 13 distributed on the wall of barrel 1 (the bars here have circular cross sections in this embodiment), and the suppressors 2 may be fabricated by fiber-reinforced plastics or Teflon to enhance the wearability and flexibility of the suppressors.

The two casing tubes 3 and 4 are tubes with default lengths determined according to the external diameter of the barrel 1, wherein a concave section 31 is configured inside one end of the casing tube 3, and a slightly smaller receiving section 41 is configured at a corresponding end of the other casing tube 4 so that the concave section 31 of the casing tube 3 may directionally engage with the slightly smaller receiving section 41 of the other casing tube 4.

The adjustment tube 5 is a properly flexible tube determined according to the external diameter of the barrel 1, wherein a proper slit 51 is formed on one side of the adjustment tube 5.

The at least two rings 6 are binding components determined according to the external diameter of the adjustment tube 5, and the surfaces of the rings 6 are configured with embosses 61 to facilitate force application when gripping and twisting by hands.

The restraining tube 7 is a restraining component determined according to the external diameter of the barrel 1 to properly restrain the direction of the adjustment tube 5 when covering the barrel 1.

The engaging barrel section 8 has on both ends external thread barrel sections 81 and 82 formed with default lengths and diameters, to allow the external thread barrel section 81 on one end screw on the corresponding internal thread barrel section 12 of barrel 1, and to allow the external thread barrel section 82 on the other end screw on one end of an operation unit of the paintball gun.

The firing barrel section 9 has formed on one end an internal thread barrel section 91 to allow screwing on the corresponding external thread barrel section 11 of barrel 1.

Figure 2:
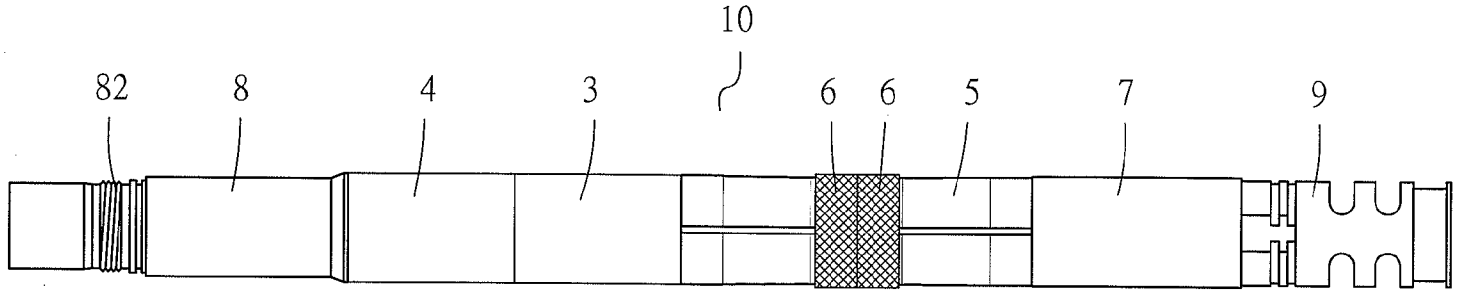
FIG. 2 is a front-view diagram of the barrel assembly of a paintball gun according to an embodiment of the invention.
Figure 3:
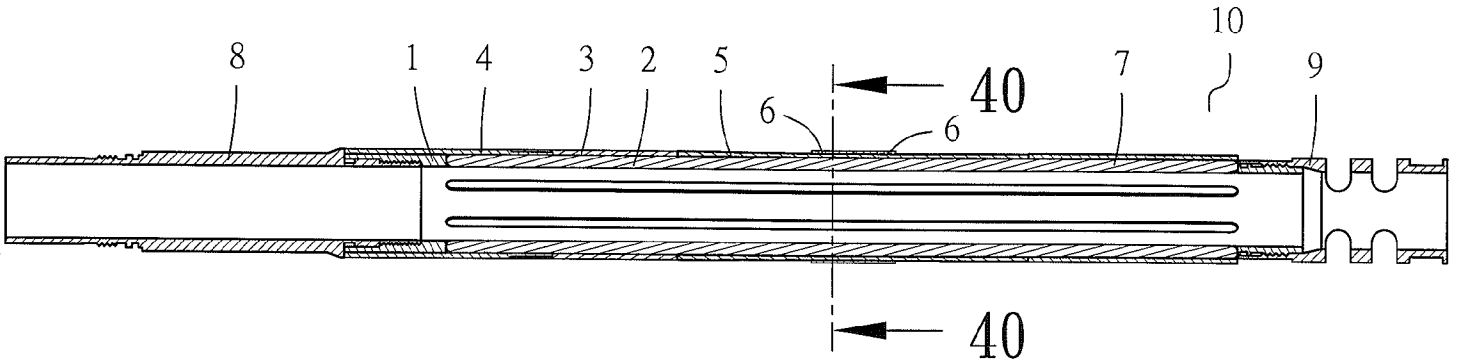
FIG. 3 is a cross-sectional view diagram of the barrel of a paintball gun according to an embodiment of the invention.
Figure 4:
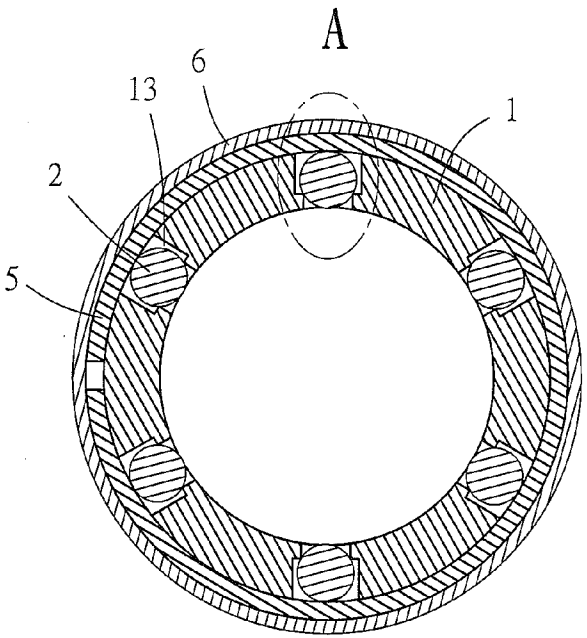
FIG. 4 is an enlarged diagram for details along the cross section 40-40 of FIG. 3.

The following is the method to assemble the barrel 1, the plurality of suppressors 2, two casing tubes 3 and 4, the adjustment tube 5, at least two rings 6, the restraining tube 7, the engaging barrel section 8, and the firing barrel section 9 (as shown in FIG. 1 and FIG. 3): in step 1, the plurality of grooves 13 distributed along the wall of the barrel 1 equidistantly are individually contained with the plurality of suppressors 2 (as shown in FIG. 4), and the inside portions of the suppressors 2 are let to slightly protrude into the interior of the barrel 1 (as shown in FIG. 4A); in step 2, sequentially configure the two casing tubes 3 and 4 on the exterior of the barrel 1 containing the suppressors 2, and let the concave section 31 of the casing tube 3 directionally engage with the slightly smaller receiving section 41 of the other casing tube 4 to directionally restrain the plurality of suppressors 2 placed on the exterior of the barrel 1; in step 3, the adjustment tube 5 with the proper slit 51 on one side directionally covers along another section of the barrel 1, and at least two rings 6 are configured on the exterior of the adjustment tube 5 to properly tighten or loosen the diameter of the adjustment tube 5 (to timely control the plurality of suppressors 2 contained in the barrel 1 to contract towards the interior of the barrel 1 or remain horizontal normally); in step 4, a restraining tube 7 is configured at the outlet end of the barrel 1 to directionally restrain the adjustment tube 5; in step 5, connect the engaging barrel section 8 at the inlet end of the barrel 1 and connect the firing barrel section 9 at the outlet end of the barrel 1 to construct a barrel assembly 10 (as shown in FIG. 2).

Figure 5:
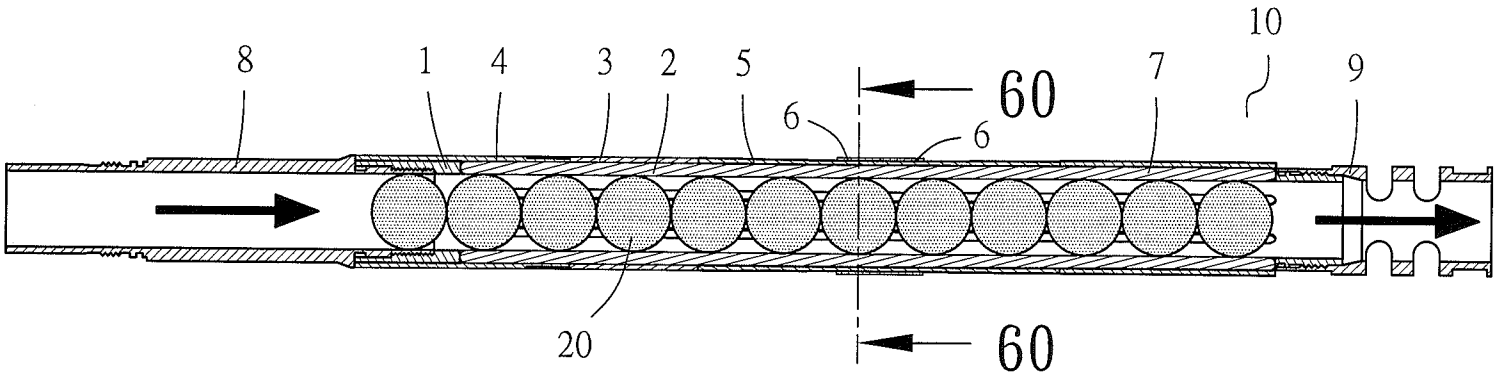
FIG. 5 is a cross-sectional view diagram of the barrel loaded with standard-sized paint balls according to an embodiment of the invention.
Figure 6A:
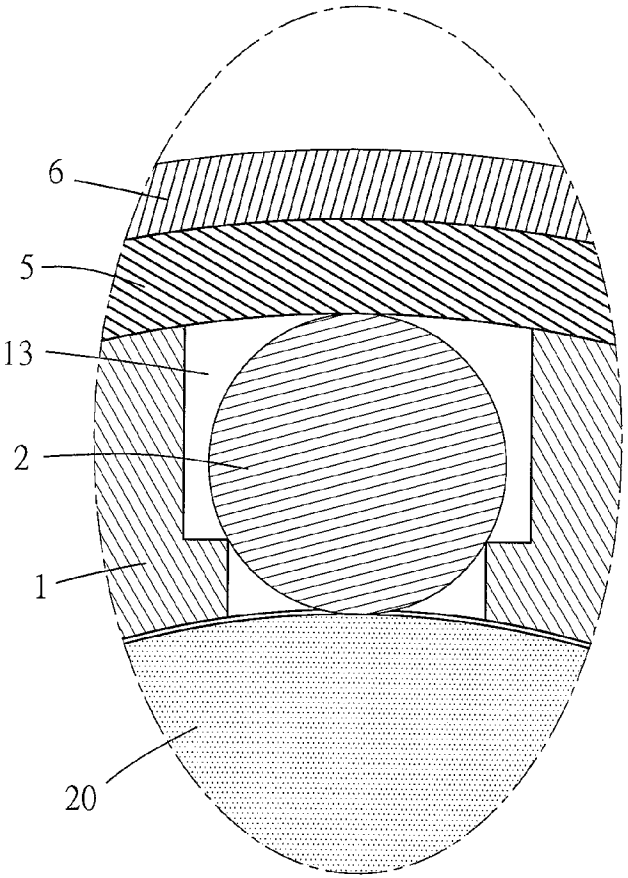
FIG. 6A is an enlarged diagram for details of part A of FIG. 6.
Figure 6:
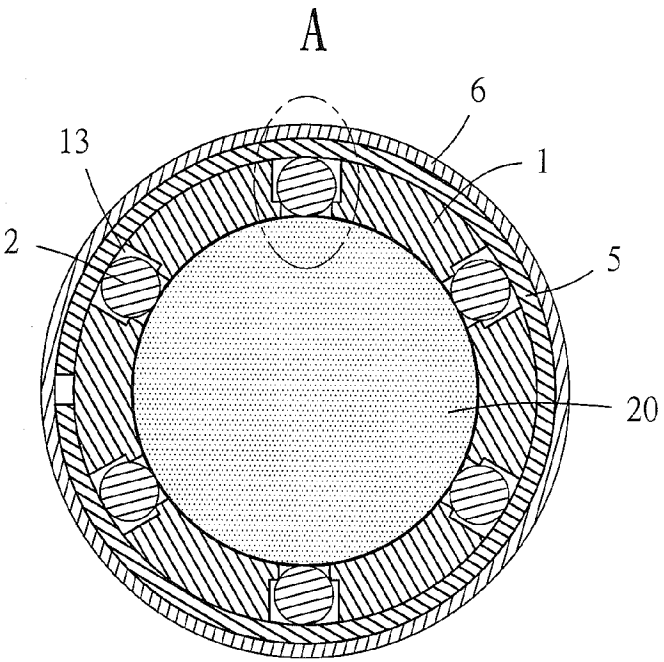
FIG. 6 is an enlarged diagram for details along the cross section 60-60 of FIG. 5.

The constructed barrel assembly 10 does not require adjusting the rings 6 on the exterior of the adjustment tube 5 for the loading of standard-sized paint balls 20 (as shown in FIG. 5), the paint balls 20 may keep proper point contact inside the barrel 1 (as shown in FIG. 6 and FIG. 6A), the wall of the barrel 1 keeps point contact with each paint ball 20 due to the suppressors 2 slightly protruding and the adhesion area of the exploded paint balls on the wall of the barrel 1 being reduced, and therefore the interference with the paint balls 20 is relatively reduced to let the paint balls 20 in the barrel 1 smoothly move forwards and await firing.

Figure 7:
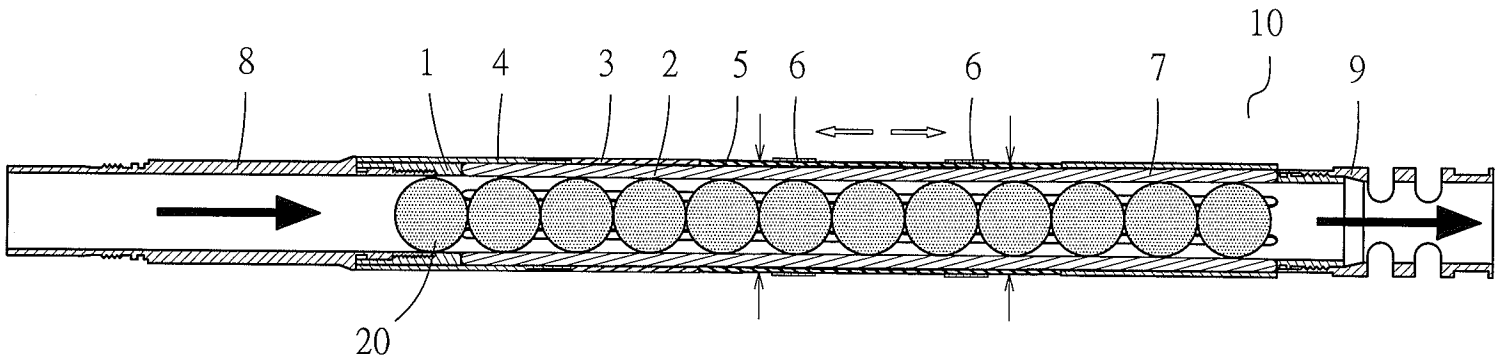
FIG. 7 is a cross-sectional view diagram of the barrel loaded with smaller-sized paint balls according to an embodiment of the invention.
Figure 7A:
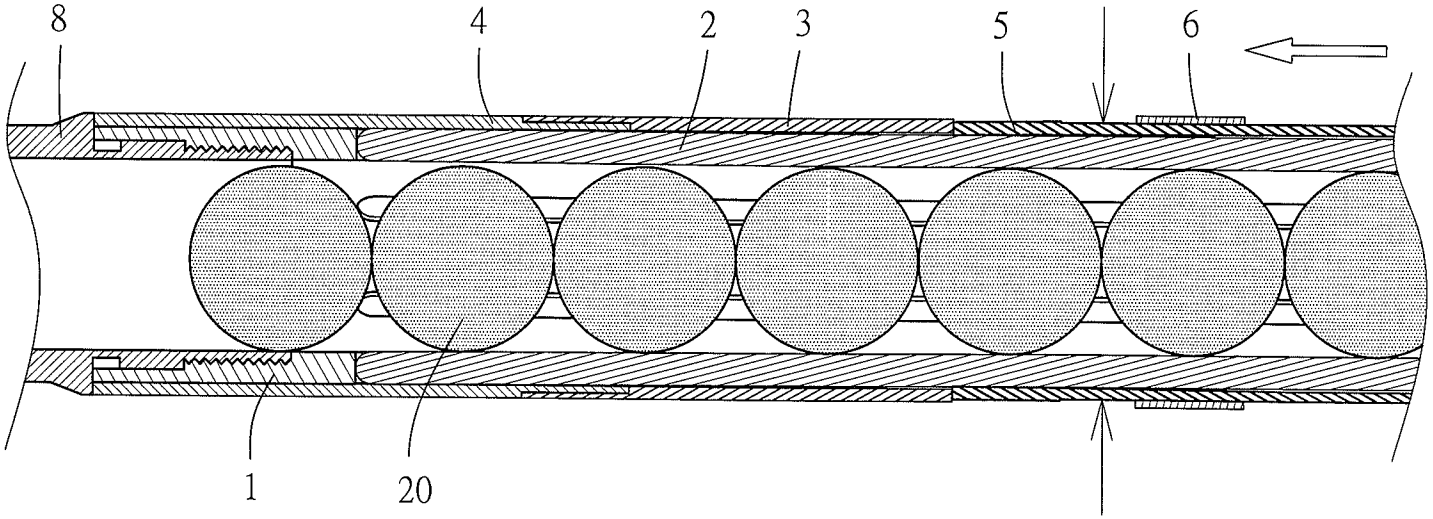
FIG. 7A is an enlarged diagram for details between the paint balls and the barrel of FIG. 7.

On the other hand, when the constructed barrel assembly 10 is loaded with smaller-sized paint balls 20 (as shown in FIG. 7), since some of the paint balls may be too small when the paint balls 20 move forwards inside the barrel 1, gaps may exist since the inner wall does not fit and thus the ballistics of the interior of the barrel is not stable and firing cannot be done with high accuracy. Under such a situation, the at least two rings 6 configured on the exterior of the adjustment tube 5 on the default section of barrel 1 may be reversely pushed out (along the direction of arrows in FIG. 7) to properly tighten or loosen the diameter of the adjustment tube 5 (here the two rings 6 are reversely pushed out so that the inner diameter of the corresponding portion of barrel 1 is reduced inwards (contracted along the upper and lower arrows in FIG. 7), and correspondingly the suppressor 2 contained in the groove 13 is also pushed inwards by the wall of the barrel 1 (as shown in FIG. 7A) so that the suppressor 2 is deformed in a way that it is contracted inwards at the middle section and remains normal at the two outer ends), and the inner diameter of the barrel 1 may be changed by the deformed adjustment tube 5 to properly restore the wall of the barrel 1 to keep proper point contact with the paint balls 20 and restore the stability of the ballistics of the interior of the barrel 1 for the paint balls 20, and the configuration of excess interference with the surfaces of the paint balls 20 is prevented so that the paint balls 20 are fired with high accuracy when being fired towards the barrel 1 under the control of an operation unit.

The barrel assembly described in above possesses the following benefits during usage: (1) reduces the instability of the ballistics of the interior of the barrel caused by interference; (2) the inner diameter of the barrel may be fine-tuned by the adjustment tube to provide stability when firing the paint balls; (3) the exploded-paint-ball phenomenon generated during the usage of paintball guns may be significantly reduced by the proper point contact formed between the plurality of suppressors slightly protruding from the barrel wall with the surfaces of the paint balls, and the unnecessary paint stain may be avoided to enhance the stability of firing.

What is claimed is:

1. A paintball gun barrel structure for a barrel assembly of a paintball gun, comprising an engaging barrel section connected at an inlet end of a barrel and a firing barrel section connected at an outlet end of the barrel, wherein the improvement comprises:

a plurality of grooves symmetrically distributed along a wall of a default section of the barrel equidistantly, wherein each groove is wide on the outside and narrow on the inside and is connected to an interior of the barrel to individually contain a suppressor and to let an inside portion of the suppressor to slightly protrude into the interior of the barrel, and wherein a concave section inside one end of a casing tube is directionally engaged with a slightly smaller receiving section of a corresponding end of another casing tube on an exterior of the barrel containing the suppressor to directionally restrain a plurality of suppressors placed on the exterior of the barrel wherein each groove has a first end adjacent to the inlet end and a second end adjacent to the outlet end, with the first ends of the plurality of grooves equidistant from the inlet end and the second ends of the plurality of grooves equidistant from the outlet end, wherein each suppressor has cross sections of a constant size perpendicular to the barrel;

and an adjustment tube with a proper slit on one side directionally covering along another section of the barrel, wherein at least two rings are configured on an exterior of the adjustment tube to properly tighten or loosen the diameter of the adjustment tube and to timely control the plurality of suppressors contained in the barrel to contract towards the interior of the barrel or remain horizontal normally, and wherein a restraining tube is configured at the outlet end of the barrel to directionally restrain the adjustment tube, wherein the barrel assembly properly controls the tightness of the adjustment tube by the displacement of the at least two rings configured on the exterior of the adjustment tube according to the size of a paint ball when the paint ball is loaded into the barrel, to keep proper point contact of the plurality of suppressors contained in the barrel wall with the surface of the paint ball, and to prevent configuring excess interference with the surface of the paint ball so that the paint ball is fired with high accuracy when being fired towards the barrel under the control of an operation unit.

2. The paintball gun barrel structure as claimed in claim 1, wherein the plurality of suppressors is fabricated by fiber-reinforced plastics or Teflon.

3. The paintball gun barrel structure as claimed in claim 1, wherein each of the plurality of grooves distributed along the default section of the wall of the barrel equidistantly is in the interval form of being deeper on the upper side and shallower on the lower side.

4. The paintball gun barrel structure as claimed in claim 1, wherein each of the plurality of grooves distributed along the default section of the wall of the barrel equidistantly extends in parallel.

5. The paintball gun barrel structure as claimed in claim 1, wherein each of the plurality of grooves distributed along the default section of the wall of the barrel equidistantly extends in helical.

6. The paintball gun barrel structure as claimed in claim 1, wherein the surfaces of the rings configured on the exterior of the adjustment tube with the proper slit on one side covering along another section of the barrel are embossed to facilitate force application when gripping and twisting by hands.

* * * * *